United States Patent [19]

Williams

[11] Patent Number: 4,735,008

[45] Date of Patent: Apr. 5, 1988

[54] PISTOL GRIP WITH A COLLAPSIBLE STABILIZING WING

[76] Inventor: Edgar L. Williams, 9529 Prairie, Chicago, Ill. 60628

[21] Appl. No.: 928,567

[22] Filed: Nov. 10, 1986

[51] Int. Cl.[4] ..... F41C 23/00

[52] U.S. Cl. ..... 42/71.02; 42/72; 42/73

[58] Field of Search ..... 42/71.01, 71.02, 72, 42/73

[56] References Cited

U.S. PATENT DOCUMENTS 1,027,556 5/1912 Marshall ..... 42/72
2,547,180 4/1951 Taylor ..... 42/72 X
4,321,765 3/1982 Gillum ..... 42/72
4,660,311 4/1987 Breitfeld et al. ..... 42/72

FOREIGN PATENT DOCUMENTS 3402481 8/1985 Fed. Rep. of Germany ..... 42/71.02

*Primary Examiner*—Ted L. Parr

[57] ABSTRACT

A pistol grip with a collapsible stabilizing wing pivotally secured to the frame of a pistol and resiliently biased to an open position which is generally perpendicular to the pistol frame. A locking mechanism secures the stabilizing wing in its closed position, parallel to the pistol frame, and a release mechanism is operable to selectively unlock the stabilizing wing allowing it to spring to its open position for two hand firing.

4 Claims, 1 Drawing Sheet

PISTOL GRIP WITH A COLLAPSIBLE STABILIZING WING

BACKGROUND OF THE INVENTION

The present invention is directed to pistol grips specially designed for two-handed gripping of a pistol. Use of both hands, when firing a pistol, steadies the pistol and greatly improves aim and reliability. Numerous weapon stabilizer arrangements are shown in the prior art U.S. Pat. Nos. 2,441,487, 3,184,877, 3,609,902, 3,648,396, 4,321,765 and 4,579,037. None of these arrangements suggests the use of a collapsible stabilizing wing secured to a pistol grip.

SUMMARY OF THE INVENTION

The present invention provides a compact pistol grip which features a collapsible stabilizing wing selectively actuable by the pistol operator to spring to an operating position which is substantially perpendicular to the pistol frame to accommodate two-hand firing of the pistol.

DETAILED DESCRIPTION OF THE INVENTION

Figure 1:
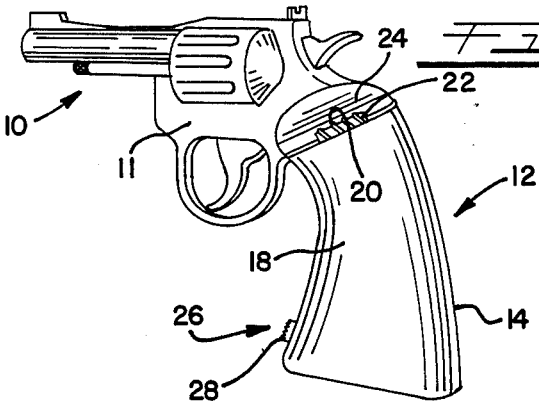
FIG. 1 shows a perspective view of a pistol including a grip with a stabilizing wing in its closed position.
Figure 2:
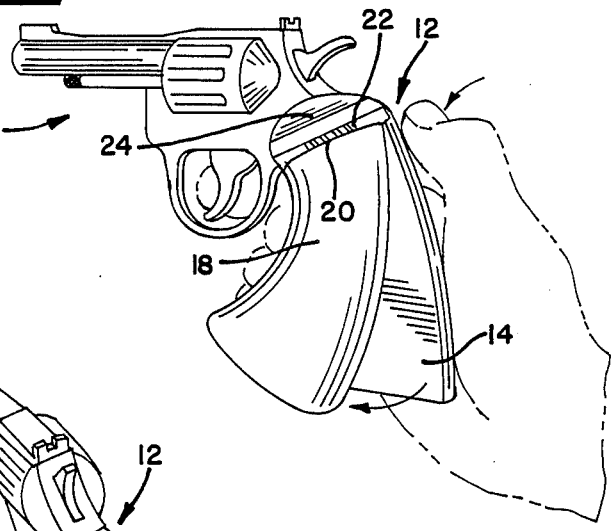
FIG. 2 shows a perspective view of the pistol and grip with a hand, in phantom, after the release mechanism has been activated with the stabilizing wing pivoted partially toward the open position.

As shown in FIG. 1, a revolver 10 is illustrated including a metal frame 11 and a pistol grip generally shown as 12. In the preferred embodiment, the pistol grip 12 is comprised of a base member 14, a complementary grip element 16 and a collapsible stabilizing wing 18. The base member 14 and the grip element 16 are secured together through the handle section of the pistol frame 11 of the revolver 10. This securement can be by any conventional fastening arrangement, as for example, small screws or nuts and bolts, which are not shown. It is also within the purview of the present invention to eliminate the base member 14, as a separate element, and pivotally connect the wing 18 directly to the pistol frame 11 thereby utilizing the frame as the base member. The arrangement shown in FIG. 3, however, is preferred since it provides a better gripping surface. The individual elements 14, 16 and 18 of the pistol grip 12 may be formed of wood, plastic or any other suitable grip material.

The stabilizing wing 18 is pivotally secured to the upper end of the base member 14 by a hinge 22 or any other device which would connect the elements together and allow the wing to pivot. A resilient biasing mechanism shown in the form of a spring 20 may be incorporated into the hinge 22 or may be separately connected between the wing 18 and the base member 14 to urge the elements toward the position illustrated in FIG. 3.

Figure 3:
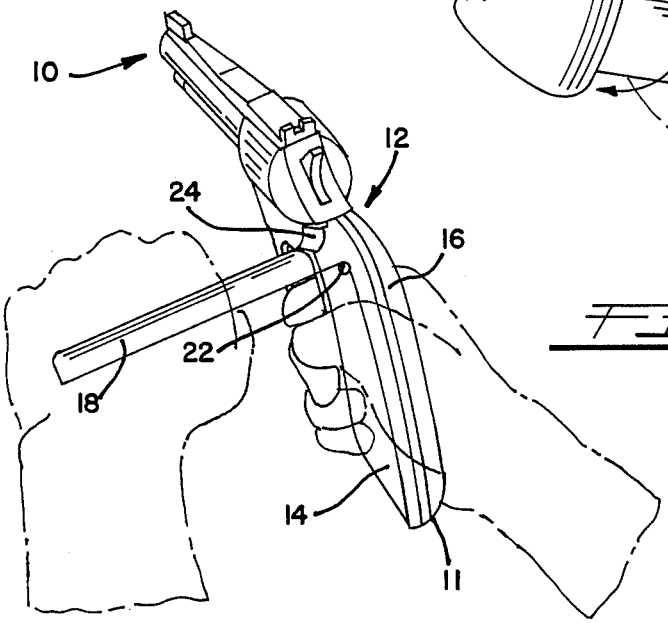
FIG. 3 shows a perspective view of the pistol and grip with the stabilizing wing in a fully opened position with one hand, in phantom, grasping the wing and the other hand, in phantom, grasping the pistol grip.

As illustrated in FIG. 1, the stabilizing wing 18, in a closed position, lies parallel to and closely adjacent the base member 14 such that the stabilizing wing 18 also functions as one portion of the pistol grip 12. When the stabilizing wing 18 is in the open position, as shown in FIG. 3, it lies substantially perpendicular to the base member 14.

A stop 24 is provided above the hinge 22 on the upper outside face of the base member 14, so that when the stabilizing wing 18 pivots to the open position about the hinge 22, the stop 24 prevents the wing 18 from pivoting further than its perpendicular location. Although the drawings illustrate the stop 24 as an integral part of the base member 14, other embodiments may include other arrangements which function in a similar manner.

Any suitable locking mechanism may be provided associated with the base member 14 and the stabilizing wing 18 so that the wing may be secured to the base member in a closed position. No such mechanism has been specifically illustrated but any of a variety of latching or locking mechanisms which are readily available would accomplish this result. For example, a hook can be provided on the wing 18 which can be releasably connected over a rod on the base member 14. Alternatively, a male member with projections can be provided on either wing 18 or base member 14 designed to engage and be secured within a female housing disposed on the complementary face of the other member.

A release mechanism including a button 28, is associated with the locking mechanism. FIG. 1 shows the button located on the lower inside portion of the wing 18 for engagement by the "little" or "baby" or "pinky" finger of the right hand. The button 28 may be selectively activated by the holder of the revolver to unlock the locking mechanism thereby allowing the wing 18 to spring to its open position.

The operation of the present invention is as follows. When the person firing the pistol wishes to utilize the "combat" or two-hand firing position, the release mechanism 28 is activated. The locking mechanism is unlocked allowing the stabilizing wing 18 to spring upward pivoting about the hinge 22 under the force of the spring 20 until the stabilizing wing 18 contacts the stop 24 at which time the stabilizing wing 18 lies in a substantially perpendicular position to the frame 11 of the pistol and the base member 14. The holder of the pistol may then grasp the stabilizing wing 18 with the free hand, thereby providing stability, which in turn provides increased accuracy and ease in firing the revolver. The stabilizing wing 18 may be returned to a closed position by simply pushing it downward toward the base member 14 until the stabilizing wing 18 is again parallal to and adjacent to the base member 14 and the locking mechanism is resecured.

Although the drawings illustrate a pistol grip utilizing the features of the present invention which is specifically designed for a right handed person, the elements of the grip can be easily redesigned, in mirror image, to accommodate a left-handed person. The pistol grip of the present invention provides a unique arrangement which is compact and inconspicuous in its locked position and which takes up no more space than a standard grip. The grip instantly transforms into an effective stabilizer, when activated, providing increased firing accuracy and comfort by providing a convenient grasping element for the free hand.

Various features of the invention have been particularly shown and described in connection with the illustrated embodiment of the invention, however, it must be understood that these particular arrangements merely illustrate and that the invention is to be given its fullest interpretation with the terms of the appended claims.

What is claimed is:

1. A grip for a pistol having a central frame member including a spring-loaded collapsible stabilizing wing having an upper end and a lower end, said wing pivotally secured to said frame member adjacent said upper end of said wing, said wing adapted to assume a closed position, wherein said wing lies parallel to and closely adjacent said frame member, or an open position, wherein said wing lies substantially perpendicular to said frame member, resilient biasing means associated with said frame member and said stabilizing wing so as to urge said wing toward its open position, locking means associated with said frame member and said stabilizing wing to secure said wing in its closed position, release means associated with said locking means, selectively operable by a holder of said pistol, to unlock said locking means whereby said resilient biasing means causes said stabilizing wing to spring from its closed position, to its open position, with said upper end of said wing adjacent to said frame to allow grasping of the wing by a hand of a pistol operator.

2. A pistol grip with a collapsible stabilizing wing as in claim 1 including stop means adapted to be contacted by said wing to limit pivotal movement of said wing to its open position whereby said wing is substantially perpendicular to said frame member.

3. A pistol grip with a collapsible stabilizing wing as in claim 1 in which said stabilizing wing also functions as one portion of said pistol grip in its closed position.

4. A pistol grip with a collapsible stabilizing wing as in claim 3 including a separate grip element adapted to be secured to said frame member on a side opposite the side on which said stabilizing wing is secured.

* * * * *